US005993054A

United States Patent [19]

Tan et al.

[11] Patent Number: 5,993,054

[45] Date of Patent: Nov. 30, 1999

[54] SYSTEM AND METHOD FOR CONTINUOUSLY AND SIMULTANEOUSLY INJECTING TWO OR MORE ADDITIVES INTO A MAIN STREAM OF OLEAGINOUS LIQUID

[75] Inventors: Gerard BH Tan, Short Hills, N.J.; Brian William Davies, Oxfordshire, United Kingdom; Francesco L Baracchini, Genoa, Italy

[73] Assignee: Exxon Chemical Patents, Inc., Linden, N.J.

[21] Appl. No.: 08/875,258

[22] PCT Filed: Feb. 24, 1995

[86] PCT No.: PCT/EP95/00696

§ 371 Date: Sep. 10, 1997

§ 102(e) Date: Sep. 10, 1997

[87] PCT Pub. No.: WO96/26002

PCT Pub. Date: Aug. 29, 1996

[51] Int. Cl.[6] ..... B01F 15/04

[52] U.S. Cl. ..... 366/152.1; 366/160.2

[58] Field of Search ..... 366/132, 134, 366/150.1, 151.1, 152.1, 152.2, 152.3, 152.4, 160.1–160.3, 160.5, 162.1, 167.1, 177.1, 182.1–182.4; 137/3–5, 7, 88, 92, 93

[56] References Cited

U.S. PATENT DOCUMENTS

| | | | |
|---|---|---|---|
| 2,917,465 | 12/1959 | Begley . | |
| 3,608,869 | 9/1971 | Woodle | 366/160.2 |
| 3,702,619 | 11/1972 | Son | 137/3 |
| 4,403,866 | 9/1983 | Falcoff et al. | 366/152.1 |
| 4,427,298 | 1/1984 | Fahy et al. | 366/160.1 |
| 4,475,821 | 10/1984 | Koch et al. | 366/160.1 |
| 4,621,927 | 11/1986 | Hiroi | 366/132 |
| 4,684,488 | 8/1987 | Rudolph . | |
| 4,706,892 | 11/1987 | Klose . | |
| 4,964,732 | 10/1990 | Cadeo et al. | 366/152.1 |
| 5,295,505 | 3/1994 | Polaschegg et al. . | |
| 5,312,595 | 5/1994 | Moffett et al. | 366/160.2 |
| 5,332,311 | 7/1994 | Volk, Jr. et al. | 366/152.2 |

FOREIGN PATENT DOCUMENTS

| | | | |
|---|---|---|---|
| 0 191 338 A3 | 2/1985 | European Pat. Off. . | |
| 0 214 843 A3 | 9/1985 | European Pat. Off. . | |
| 0 210 294 A1 | 2/1987 | European Pat. Off. . | |
| 2 123 433 | 9/1972 | France . | |
| 3800788 | 7/1989 | Germany | 366/152.1 |
| 61-146329 | 7/1986 | Japan | 366/152.1 |
| 61-192329 | 8/1986 | Japan | 366/152.1 |
| WO96/26002 | 8/1996 | WIPO . | |

*Primary Examiner*—Charles E. Cooley
*Attorney, Agent, or Firm*—Ohlandt, Greeley, Ruggiero & Perle

[57] ABSTRACT

Additives are blended with a stream of liquid, for example of diesel fuel, by injecting at least two different additive compositions into the stream, and adjusting the rates of injection and the relative proportions of the injected additive compositions. This enables the consumption of additives to be minimized while enabling desired fuel characteristics to be maintained despite variations in the characteristics of the untreated liquid. The rates of injection may be adjusted by an automatic controller (32) in response to signals from sensors (28, 30) representing characteristics of the liquid before and after treatment.

15 Claims, 1 Drawing Sheet

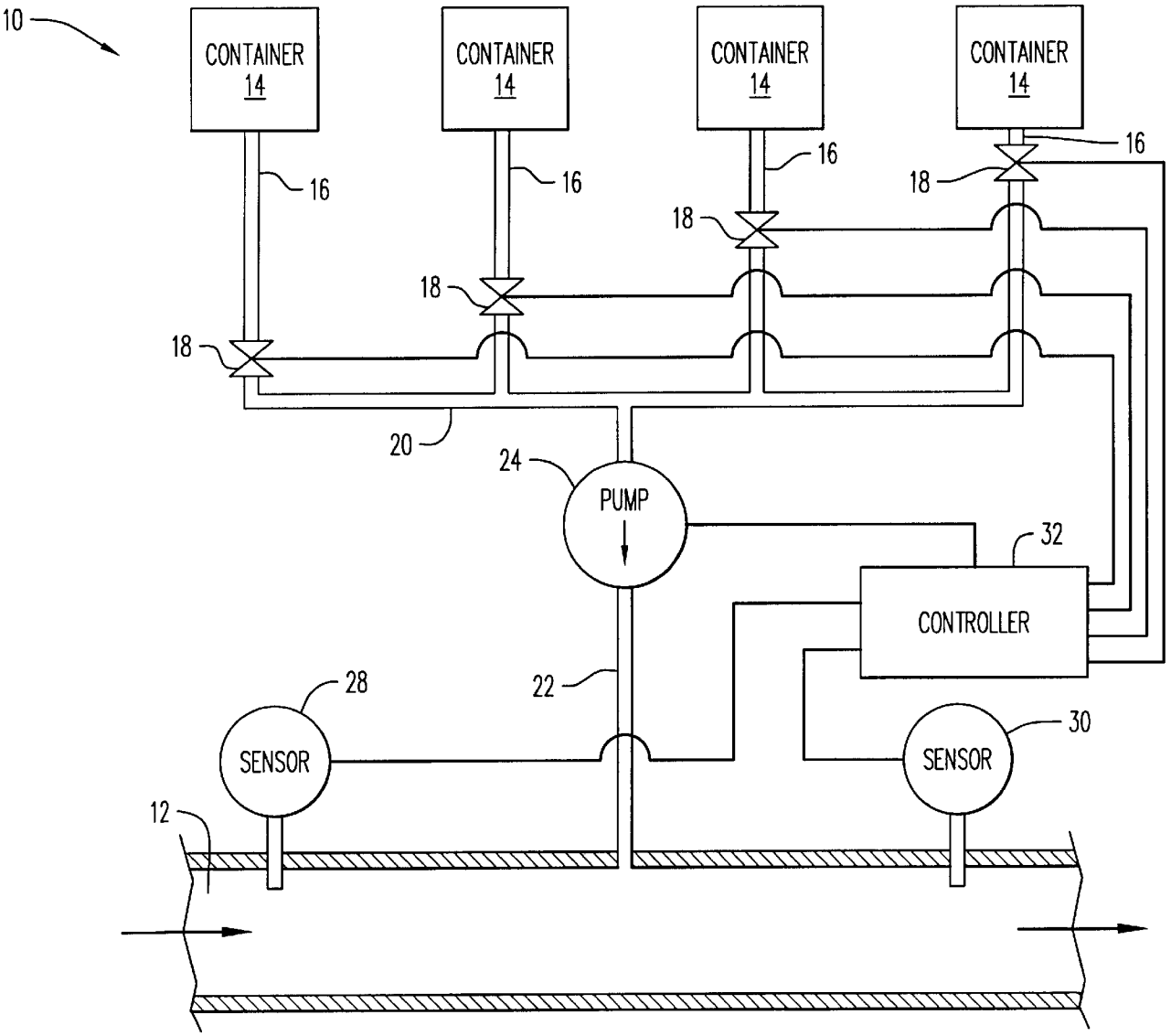
CONTAINER 14
CONTAINER 14
CONTAINER 14
CONTAINER 14
16
16
16
16
18
18
18
18
PUMP
24
20
22
CONTROLLER
32
SENSOR
30
SENSOR
28
12
10

SYSTEM AND METHOD FOR CONTINUOUSLY AND SIMULTANEOUSLY INJECTING TWO OR MORE ADDITIVES INTO A MAIN STREAM OF OLEAGINOUS LIQUID

FIELD OF THE INVENTION

The present invention relates to a system and to a method for blending additives with a main stream of a liquid, particularly but not exclusively where the liquid is an oleaginous liquid.

BACKGROUND OF THE INVENTION

Oleaginous materials such as crude oils, lubricating oils, heating oils and other distillate petroleum fuels, for example diesel fuels, contain alkanes that at low temperature tend to precipitate as large crystals of wax forming a gel structure so that the fuel or oil loses its ability to flow. The lowest temperature at which the crude oil, lubricating oil or fuel oil will still flow is known as the pour point. In the case of fuels as the temperature of the fuel falls and approaches the pour point, difficulties arise in transporting the fuel through lines and pumps. Further, the wax crystals tend to plug fuel lines, screens and filters at temperatures above the pour point. These problems are well recognized in the art, and various additives have been proposed, many of which are in commercial use, for depressing the pour point of fuel oils. Similarly, other additives have been proposed and are in commercial use, for reducing the size and changing the shape of the wax crystals that do form. Other additives may also retain wax crystals in suspension, and may be referred to as anti-settling aids. Additives may also be added to improve other properties of the fuel oil, for example to act as corrosion inhibitors, or detergents or to inhibit sediment formation.

The invention is relevant but not restricted to fuel oils, including those boiling in the gasoline range, but is particularly relevant to those liquids referred to as middle distillate fuel oils. These fuel oils typically boil in the range of about 120° C. to about 500° C., and may comprise atmospheric distillate or vacuum distillate, or cracked gas oil, or a mixture of straight-run and cracked distillates. The most common petroleum distillate fuel oils are kerosene, jet fuels, diesel fuels, and heating oils. In any event it is almost always necessary to add a small proportion, for example between 10 and 2,000 ppm by weight, of additives to the liquid as produced by a refinery, in order to produce a fuel or oil which is suitable for sale and meets desired specifications. Typically a refiner would use one additive composition for all fuels or might, in some cases, use one additive composition (A) if producing diesel fuel, or a different additive composition (B) if producing heating oil; each additive composition (A or B) comprising a mixture of the chemically-different types of additive discussed above, chosen to ensure the desired specification is met. Where the characteristics of the untreated fuel oil vary (due for example to changes in refinery operation or changes in crude oil), the refiner ensures that the desired specification continues to be met by adjusting the proportion of the additive composition (say A) which is added. In the same way the refiner can produce fuel oils which meet different specifications, for example for use in different climates, by adjusting the proportion of the additive composition (say A) which is added.

SUMMARY OF THE INVENTION

According to the present invention there is provided a system for blending additives with a main stream of liquid, the system comprising a plurality of containers for different additive compositions, means to inject into the main stream of liquid at least two additive compositions from the containers, and means to adjust, during operation, the rates of injection and the relative proportions of the different additive compositions which are injected.

Each additive composition may comprise one or more chemically-different additives as discussed above, for example a selection of pour-point depressants, wax anti-settling agents, wax crystallization modifiers, corrosion inhibitors etc. and may contain co-additives which improve the effectiveness of one or other of the additives. These components may be in admixture with a carrier liquid, e.g. dissolved or dispersed in an inactive oleaginous solvent. Some of the additive compositions may contain a single additive; others may comprise several different additives. Preferably the injected additive compositions are injected simultaneously, and through a common injector, into the liquid stream. Alternatively they may be injected through different injectors, which injectors may be spaced apart either in the direction of the liquid flow or transverse to that direction.

The adjustment means may comprise separate adjustable pumps to pump the different additive compositions to the injector means, or may comprise separate flow restrictor valves to control the flow rates of the different additive compositions.

Desirably the system is automated, and includes computerised control means to operate the adjustment means in accordance with input data representing measured or measured and computed characteristics of the untreated liquid or fuel components and input data representing the desired specification of the blended liquid, and a database relating to the effect of the different additive compositions on the different liquids.

By adjusting the relative proportions of the different additive compositions the overall consumption of additives can be reduced, saving unnecessary expense. This is because the composition of what is injected, being made up of adjustable proportions of the different additive compositions, can be optimised:

a) to accommodate variations in the characteristics of the untreated liquid, for example due to changes in distillation cut-point, or the type of crude oil; and b) to achieve a variety of different product specifications, for example different fuel grades, or different requirements between summer and winter, or different product types.

These aims can be achieved while avoiding the waste involved in injecting a particular additive as part of a standard additive composition at higher injection rates than are required in a particular situation, merely because that injection rate is necessary in relation to another component of that standard additive composition. In particular, additive compositions in the present invention may not be discrete additives optimised for different fuels but sub-assemblies of additives that, when admixed in situ, provide the minimum overall additive consumption.

Desirably, in an automated system, the control means is also responsive to input data representing measured characteristics of the treated liquid. The system preferably includes measuring means to determine characteristics of the untreated liquid, and of the treated liquid, and to supply the requisite input data to the control means.

In a second a spect the invention provides a method for blending additives with a main stream of liquid, the method comprising injecting into the main stream of liquid a plurality of different additive compositions, and adjusting, during operation, the rates of injection and the relative proportions of the different additive compositions to provide a blended liquid having desired characteristics.

BRIEF DESCRIPTION OF THE DRAWING

The invention will now be further and more particularly described by way of example only and with reference to the accompanying drawing which shows a diagrammatic view of an additive blending system.

DETAILED DESCRIPTION OF THE INVENTION

Referring to the drawing, an additive blending system 10 is shown for injecting additives into a flow of oil/fuel flowing in the direction shown by arrows along a pipe 12 from a production unit (not shown) to a storage tank (not shown). Typically the production unit would be an oil refinery and the flowing liquid might be intended as heating oil or diesel fuel. Four containers 14 are arranged near the pipe 12, each with an outlet tube 16 incorporating an electrically adjustable valve 18, all the tubes 16 communicating via a common manifold 20 to an outflow tube 22. The outflow tube 22 incorporates an electric pump 24, and communicates with the pipe 12.

A sensor 28 communicates with the pipe 12 upstream of the tube 22, and a sensor 30 communicates with the pipe 12 well downstream of the tube 22. The sensors 28, 30 measure characteristics of the oil/fuel in the tube 12 before and after the injection of additives, and provide the results of these measurements as input data to a computerised controller 32. For example the sensor 28 might measure the density, the distillation temperature, and the cloud point of the oil/fuel, and the sensor 30 might measure the cold filter plugging point (CFPP) of the treated oil/fuel. The controller 32 provides output electrical signals to control operation of the pump 24 and of each of the valves 18.

In use of the system 10 each of the containers 14 contains a different additive composition. The controller 32, in response to the input data from the sensor 28 and in accordance with the specification of the oil/fuel which is required (this data being provided by an operator to the controller 32 by means of a keyboard (not shown)), determines what rate of injection of each of the different additive compositions is required. The controller 32 then supplies appropriate signals to the pump 24 and to the valves 18 so that the required quantities of the additive compositions are injected via the outflow tube 22 into the oil/fuel in the pipe 12. From the input data received from the downstream sensor 30 the controller 32 can ascertain whether or not the desired specification is being achieved; and if not, the controller 32 can adjust the injection rates of one or more of the additive compositions accordingly.

The blending system 10 thus operates automatically, blending with the untreated oil/fuel the necessary combination of additives to provide the desired specification. It will be appreciated that the operator can at any stage alter the desired specification, for example to change from producing winter diesel fuel to summer diesel fuel, and the system 10 will automatically make the necessary changes in the additives by selecting a different combination of the additive compositions (or different relative proportions of the additive compositions) from the containers 14.

As shown in the drawing the additives are injected into the flowing oil/fuel through the mouth of the outflow tube 22, which therefore constitutes the injector. It will be appreciated that the injector may take a different form, for example a jet eductor as described in WO 93/18848. The system 10 is shown as including four containers 14, but it will be appreciated that it might have a different number, desirably between two and eight; the number is merely equal to the number of different additive compositions which are to be provided. All the containers 14 are shown as being the same size, but it may be preferable to store in larger containers those additive compositions of which larger quantities are expected to be used. The system 10 might additionally be provided with meters (not shown) to measure the volume of oil/fuel which flows along the pipe 12, and to measure the volumes of the different additive compositions which are injected; these metered volumes might also be supplied as data to the controller 32, and may be recorded so that operation of the system 10 can be monitored.

The mode of operation of the controller 32 may rely on empirical calculations to relate the characteristics of the untreated oil/fuel to the necessary additions of the additive compositions, or may rely on an expert system, or a neural network. In any event because the need for additives may differ considerably for oil/fuels of only slightly different characteristics, and because the characteristics of the untreated oil/fuel from the production unit may be expected to vary continuously, it is desirable to monitor the treated oil/fuel and hence modify the treatment. That is the purpose of the sensor 30. It is also desirable to monitor the characteristics of the oil/fuel in the storage tank supplied by the pipe 12, to ensure that it meets the specifications. It is therefore desirable to provide a further sensor unit (not shown) for this purpose, whose measurements may also be supplied as input data to the controller 32.

A preferred embodiment of the invention has been described above, and it will be apparent that the system 10 can be modified in a wide variety of ways while remaining with the scope of the invention.

We claim:

1. A system for blending a plurality of different additive compositions with a main stream of oleaginous liquid to provide a resulting blended liquid, the system comprising:

a plurality of containers for the different additive compositions;

common injection means to simultaneously inject into the main stream of oleaginous liquid at least two of the different additive compositions from the containers;

means to adjust, during the injection operation, the rates of injection and the relative proportions of the at least two different additive compositions which are to be injected;

control means to operate the adjustment means in accordance with:

input data representing measured or measured and computed characteristics of the main stream of oleaginous liquid prior to the injection of the at least two different additive compositions, input data representing a desired cold filter plugging point specification of the resulting blended liquid, a database relating to the effect of the different additive compositions, and input data from a sensor means for measuring the cold filter plugging point of the blended liquid after injection of the at least two different additive compositions and for providing signals to the control means representing the measured cold filter plugging point of the blended liquid as input data to the control means.

2. A system as claimed in claim 1 also comprising sensor means for measuring the characteristics of the main stream of oleaginous liquid prior to the injection of the at least two different additive compositions, and for providing signals representing those characteristics as input data to the control means.

3. A method for blending additives with a main stream of oleaginous liquid, the method comprising simultaneously injecting into the main stream of oleaginous liquid a plurality of different additive compositions from a common injection means, adjusting, during operation, the rates of injection and the relative proportions of the different additive compositions to provide a blended liquid having a desired cold filter plugging point, and controlling the adjustment step in accordance with:

input data representing measured, or measured and computed, characteristics of the liquid prior to the injection of additives, input data representing the desired cold filter plugging point specification of the blended liquid, signals received from a sensor means measuring the cold flow plugging point of the blended liquid after injection of the plurality of different additive compositions, and a database relating to the effect of the different additive compositions.

4. A method as claimed in claim 3 wherein the oleaginous liquid is a fuel oil.

5. A method as claimed in claim 4 wherein the fuel oil is a middle distillate fuel oil.

6. A system for blending a plurality of different additive compositions with a main stream of oleaginous liquids, the system comprising:

a plurality of containers for the different additive compositions;

common injection means for simultaneously injecting into the main stream of oleaginous liquid at least two of the different additive compositions from the containers to produce a blending liquid composition;

means to adjust, during the injection operation, the rates of injection and relative proportions of the at least two different additive compositions which are to be injected;

control means for providing output signals to control operation of the means to adjust in accordance with input data;

first input means for providing first input data to the control means, said first input data representing one or more measured, or measured and computed, characteristics of the main stream of oleaginous liquid prior to injection of the at least two different additive compositions;

second input means comprising a sensor means for measuring the cold flow filter plugging point of the blended liquid composition after injection of the at least two different additive compositions and for providing signals representing the measured cold filter plugging point of the blended liquid composition as second input data to the control means, and third input means for providing third input data to the control means, said third input data representing the desired cold filter plugging point specification of the blended liquid composition.

7. The system according to claim 6 further comprising a database for providing to the control means further input data representing characteristics of each of the plurality of different additive compositions.

8. The system according to claim 7, wherein the first input means comprises a sensor means for measuring the characteristics of the main stream of oleaginous liquid prior to the injection of the at least two different additive compositions and for providing signals to the control means representing those characteristics as the first input data.

9. The system according to claim 6, wherein the first input means comprises a sensor means for measuring the characteristics of the main stream of oleaginous liquid prior to the injection of the at least two different additive compositions and for providing signals to the control means representing those characteristics as the first input data.

10. A method for blending a plurality of different additive compositions with a main stream of oleaginous liquid to provide a resulting blended liquid composition having a desired cold filter plugging point, the method comprising:

simultaneously injecting into the main stream of oleaginous liquid at least two different additive compositions;

adjusting, during the injecting step, the rates of injection and relative proportions of the at least two different additive compositions to provide the blended liquid composition; and controlling the adjusting of the rates of injection and relative proportions of the at least two different additive compositions in accordance with:

(1) first input data representing one or more measured, or measured and computed, characteristics of the main stream of oleaginous liquid;

(2) second input data comprising signals received from a sensor means for measuring the cold filter plugging point of the blended liquid composition after injection of the at least two different additive compositions and providing the signals as representative of the measured cold filter plugging point of the blended liquid composition, and (3) third input data representing the desired cold filter plugging point specification of the blended liquid composition.

11. The method according to claim 10 additionally comprising controlling the adjusting in accordance with a database providing further input data representing characteristics of each of the plurality of different additive compositions.

12. A method as claimed in claim 11 wherein the oleaginous liquid is a fuel oil.

13. A method as claimed in claim 12 wherein the fuel oil is a middle distillate fuel oil.

14. A method as claimed in claim 10 wherein the oleaginous liquid is a fuel oil.

15. A method as claimed in claim 14 wherein the fuel oil is a middle distillate fuel oil.

* * * * *